United States Patent [19]

Faure

[11] Patent Number: 4,587,802

[45] Date of Patent: May 13, 1986

[54] PROCESS FOR PIECING CORE SPUN YARNS

[75] Inventor: Jean-Louis Faure, Noley, France

[73] Assignee: ASA S.A., Villeurbanne, France

[21] Appl. No.: 637,013

[22] Filed: Aug. 2, 1984

[30] Foreign Application Priority Data

Sep. 20, 1983 [FR] France ..... 83 15114

[51] Int. Cl.[4] ..... D01H 15/00

[52] U.S. Cl. ..... 57/261; 57/22

[58] Field of Search ..... 57/1, 3, 3.5, 5, 6, 57/22, 261, 352

[56] References Cited

U.S. PATENT DOCUMENTS 1,656,258 1/1928 Yale ..... 57/22 X 1,893,590 1/1933 Mau et al. ..... 57/5 X 3,198,446 8/1965 Furst et al. ..... 57/261 X

*Primary Examiner*—Donald Watkins

*Attorney, Agent, or Firm*—Parkhurst & Oliff

[57] ABSTRACT

The invention relates to a process for piecing on a machine for producing core spun yarns, said process comprising the following successive steps of: taking off a broken end of a core spun yarn formed from the receiving member, (for example a reel); exposing the internal core of said yarn over a pre-determined length; connecting the core thus exposed with the end of the elementary core yarn; introducing the bared core into the fiber distribution system; distributing the fibers on the core downstream of the point of join; and advancing and winding normally. The invention also relates to a device for carrying out this process.

7 Claims, 8 Drawing Figures

PROCESS FOR PIECING SPUN YARNS

Figure 1:
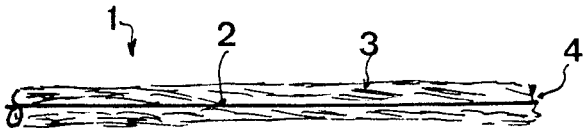

The present invention relates to a process for piecing spun yarns of fibers comprising an internal core; such spun fibers will hereinafter be referred to as "core spun yarns".

Numerous solutions for making core spun yarns have heretofore been envisaged.

The one most employed consists in introducing a multi-filament core within a rove, during the last spinning operation, i.e., on the continuous filaments to be spun, said core being introduced upstream of the last pair of rove drafting rollers.

It has also been proposed to project elementary fibers onto a continuous yarn subjected to a momentary false twist, upstream of the false twist spindle. Such projection of the elementary fibers onto the core in the zone where the twist extends back may be effected in accordance with the teachings of Applicant's European patent application No. 0085635, by means of a mobile guide surface on which said fibers are delivered tangentially and which tends to exert a tensile force on the free ends of these fibers, the core being displaced tangentially with respect to said guide surface in a direction concurrent with the direction of fiber feed.

In any case, there is the problem of piecing, particularly at a break.

Among the various solutions currently employed at the present time for making such piecings, the most simple consists in forming a knot which therefore necessarily leads to the presence of a defect (excess thickness) in the yarn after piecing.

Another solution consists in splicing.

Finally, in the case of synthetic yarns, it has been envisaged to glue or weld the filaments end to end.

As far as the core spun yarns are concerned, taking into account the different materials included in the composition thereof, only a knotting operation can be envisaged.

Now, a novel process has been found, and this is the object of the present invention, which enables core spun yarns to be pieced, while virtually eliminating any defect and which may be adapted to virtually all machines for making such spun yarns.

The invention therefore generally relates to a process for piecing, after breaking, a core spun yarn comprising an internal core surrounded by a fibrous sheath, on a machine for producing core spun yarns, said process being characterized in that it comprises the following steps in succession:

taking the end of the broken core spun yarn off of the receiving member, for example, a reel, exposing the internal core of said core spun yarn over a predetermined length, connecting the end of the thus exposed with the end of the elementary core yarn, introducing the bared connected core into the fiber distribution system, distributing the fibers on the core downstream of the point of join, and normal advance and wind.

Take-off of the yarn, connection of the core, and reintroduction in the distribution system can be effected by means of devices currently used in the textile industry which will not be described in detail in the following specification in order to simplify same. Take-off may, for example, be effected by means of a movable suction nozzle and connection may be effected by knotting, splicing, welding or gluing.

On the other hand, the yarn will be exposed by means of a special device which is also part of the present invention. Such an exposure is obtained by friction against an abrasive surface so as to push the covering fibers into packs, which are then recovered by any appropriate means, such as for example a suction system, from a second surface on which the fibers adhere.

Such exposure of the core is preferably effected by maintaining the yarn fixed, with the abrasive surface being pushed against said yarn.

The invention will be more readily understood on reading the following description with reference to the accompanying drawings, in which:

FIGS. 1 to 5 illustrate the different phases of a piecing operation made according to the process of the invention.

Figure 6:
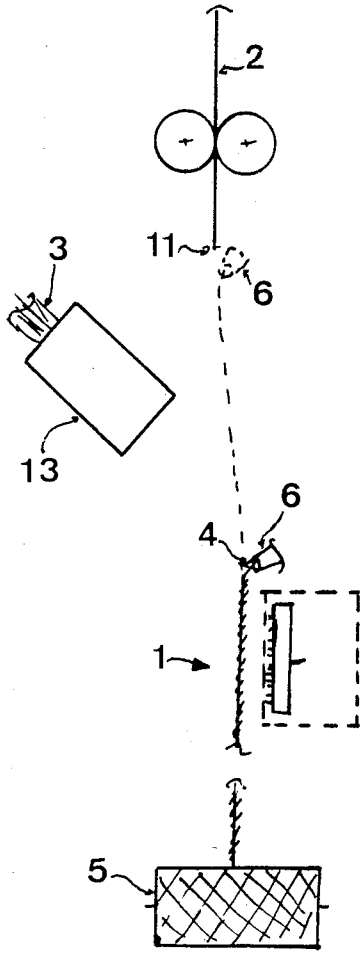

FIG. 6 schematically illustrates the manner in which the process is carried out on an installation for making a core spun yarn.

Figure 7:
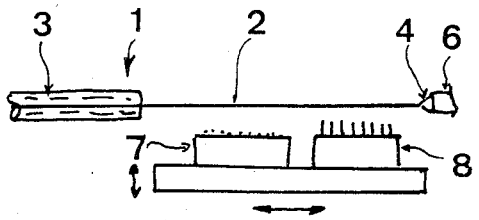
Figure 8:
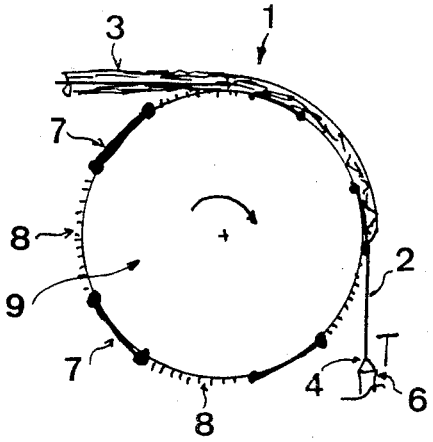

FIGS. 7 and 8 are diagrams illustating embodiments of devices for exposing the core.

The different phases of the process of piecing according to the invention are illustrated in FIGS. 1 to 5.

Referring now to the drawings, FIG. 1 shows the end of a core spun yarn generally designated by reference 1, constituted by a core 2 surrounded by a fibrous sheath 3. This yarn presents a free end 4 and is stored on a winding means 5 (cf. FIGS. 6, 7, 8).

In the event of the yarn breaking, the installation such as the one shown schematically in FIG. 6, is stopped.

In a first phase, the yarn 1 formed on the receiving member 5 is taken off by its free end, for example, by means of a suction nozzle 6, and a certain length thereof, which may go up to 50 m, is removed in order to eliminate potential defects. This done, the core 2 is bared over a pre-determined length L in a zone close to its free end 4. Such exposure of the core is obtained by friction (abrasion) so as to assemble the peripheral fibers 3 into packs without deteriorating the core 2. FIGS. 7 and 8 illustrate two devices for effecting such exposure.

In the embodiment illustrated in FIG. 7, such a device is constituted by an assembly, moved reciprocally and comprising an abrasive surface 7 and a surface 8 similar to a felt or velvet on which are deposited the peripheral fibers detached from the core 2 by the abrasive surface 7.

In the example illustrated in FIG. 8, the exposing device is constituted by a rotating drum 9 comprising a succession of abrasive surfaces 7 and of surfaces 8 for recovering the detached fibers.

Figure 2:
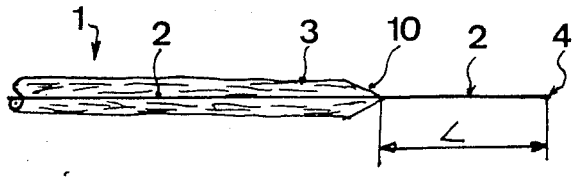
Figure 3:
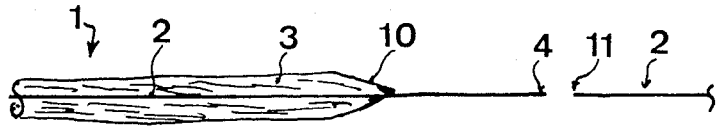
Figure 4:
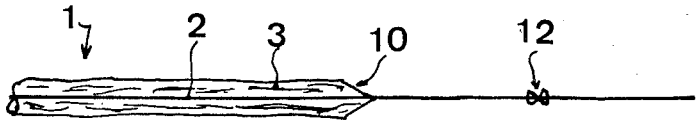

The core spun yarn 2 may be exposed, with the aid of such devices, without the properties thereof being deteriorated. Moreover, the end 10 of the covering fibers 3 is bevelled (FIG. 2).

This exposing operation having been effected, the end 4 of the bared core spun yarn is brought in the vicinity of the free end 11 of the elementary core yarn 2 (FIG. 3), this phase of operation being shown in dotted lines in FIG. 6. The two portions of core yarns 4-11 are then connected together at 12 (FIG. 4) by means of a conventional knotting device (or by any other equivalent system such as a gluing, welding, or splicing system).

Figure 5:
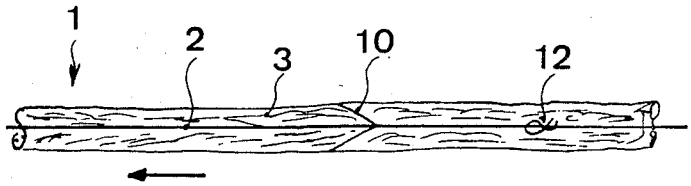

Piecing having been effected, the core spun yarn is reintroduced into the spinning system 13 proper. This operation is carried out so that, when operation resumes, the fibers 3 for covering the core 2 are delivered onto this core thus pieced downstream of the knot 12 (or any other means of join) and are deposited against the bevelled part 10 of the covering fibers of the yarn previously formed (FIG. 5).

Such a process of piecing, adaptable to virtually all machines for making core spun yarns, enables virtually any defect in the piecing zone to be eliminated. In fact, the connection being effected solely on the core, it is hidden by the covering fibers 3.

Furthermore, the process according to the invention may be applied equally well to core spun yarns of which the core is constituted by continuous multifilaments and to spun yarns in which the core is itself constituted by a spun yarn of fibers which must, of course, present a sufficient cohesion to allow it to be bared. In the latter case, it is obvious that, in the event of the yarn breaking, piecing is effected after having reformed a given length of said core.

Moreover, it is obvious that the dimensions of the means for exposing the internal core will be a function of the nature and/or the length of the fibers.

What is claimed is:

1. A process for piecing, after breaking, a core spun yarn comprising an internal core surrounded by a fibrous sheath, on a machine having:

delivery means for delivering an elementary core yarn which will become the internal core of the core spun yarn;

distribution means for distributing discontinuous fibers onto the elementary core yarn so as to form the fibrous sheath, thereby producing said core spun yarn; and receiving means for receiving the core spun yarn so produced;

the process comprising:

taking a broken end of the core spun yarn off of the receiving member;

removing the fibrous sheath from said core spun yarn to expose the internal core of said core spun yarn over a pre-determined length at said broken end thereof;

connecting said broken end of the thus exposed internal core with an end of the elementary core yarn;

introducing the connected exposed core and elementary core yarn into the distribution means;

distributing fibers on the exposed core and elementary core beginning at the point of said bared core opposite said broken end and continuing along said elementary core, thereby again continuing production of core spun yarn; and resuming normal advance and winding of said receiving member.

2. The process according to claim 1, wherein a movable suction nozzle is provided to take said broken end of said core spun yarn off of said receiving member, and wherein said exposed core is connected to said elementary core yarn by a process selected from the group consisting of knotting, splicing, welding and gluing.

3. The process according to claim 1, wherein the fibrous sheath of said core spun yarn is removed by abrasion against an abrasive surface, the covering fibers abraded by said surface thereafter being recovered.

4. The process according to claim 3, wherein said abrasion is carried out by holding the core spun yarn fixed while moving an abrasive surface thereagainst.

5. The process according to claim 1, wherein said fibrous sheath is removed such that the fibrous sheath at the end of said exposed core opposite said broken end is beveled, and fibers are applied to said exposed core beginning at said beveled portion of said fibrous sheath.

6. Process of any one of claims 1 to 5, wherein said core is exposed over said predetermined length by moving means moving against said fibrous sheath, said moving means comprising:

at least one abrasive surface for abrading the fibrous sheath of said core spun yarn so as to bare the internal core of said yarn over said pre-determined length;

at least one collection surface for collecting the fibers abraded from said core spun yarn by said abrasive surface.

7. The process of claim 6, wherein said moving means further comprises a rotating drum having disposed thereon an alternating succession of said abrasive surfaces and collecting surfaces.

* * * * *